US009653228B2

(12) United States Patent
Sanford et al.

(10) Patent No.: US 9,653,228 B2
(45) Date of Patent: May 16, 2017

(54) COSMETIC DOME SWITCH

(75) Inventors: Emery Sanford, San Francisco, CA (US); Douglas Joseph Weber, Arcadia, CA (US); Stephen Zadesky, Portola Valley, CA (US)

(73) Assignee: APPLE INC., Cupertino, CA (US)

( * ) Notice: Subject to any disclaimer, the term of this patent is extended or adjusted under 35 U.S.C. 154(b) by 1160 days.

(21) Appl. No.: 12/194,323

(22) Filed: Aug. 19, 2008

(65) Prior Publication Data

US 2009/0078553 A1 Mar. 26, 2009

(51) Int. Cl.
*H01H 1/10* (2006.01)
*H01H 13/14* (2006.01)

(52) U.S. Cl.
CPC ..... *H01H 13/14* (2013.01); *H01H 2205/002* (2013.01); *H01H 2221/044* (2013.01); *H01H 2235/004* (2013.01); *Y10T 29/49105* (2015.01)

(58) Field of Classification Search
CPC .... H01H 13/70; H01H 13/702; H01H 13/703; H01H 13/704; H01H 13/7073; H01H 13/7006; H01H 13/14; H01H 2221/044; H01H 17/86; H01H 13/06; H01H 13/48; H01H 13/52; H01H 13/705
USPC ..... 200/293, 296, 341–343, 301, 302.1, 200/302.2, 509–520
See application file for complete search history.

(56) References Cited

U.S. PATENT DOCUMENTS

| | | | | |
|---|---|---|---|---|
| 5,939,690 | A * | 8/1999 | Yasui et al. | 200/302.2 |
| 6,303,888 | B1 * | 10/2001 | Okamoto et al. | 200/517 |
| 6,603,086 | B2 * | 8/2003 | Kawaguchi et al. | 200/517 |
| 6,756,555 | B2 * | 6/2004 | Lin | 200/512 |
| 7,235,755 | B2 * | 6/2007 | Wang | 200/512 |
| 7,378,609 | B1 * | 5/2008 | Fedorjaka | 200/516 |
| 2005/0061650 | A1 * | 3/2005 | Imamura | G08C 23/04 200/512 |
| 2008/0105526 | A1 * | 5/2008 | Wee et al. | 200/5 A |

* cited by examiner

*Primary Examiner* — Renne S Luebke
*Assistant Examiner* — Lheiren Mae A Caroc
(74) *Attorney, Agent, or Firm* — Brownstein Hyatt Farber Schreck, LLP

(57) ABSTRACT

The systems and methods described herein are directed to a switch for use in an electronic device. The switching assembly may include an elastically deformable actuator having a conductive inner surface and a cosmetic outer surface. The actuator may be disposed on an exterior surface of an enclosure that houses an electric circuit board of the electronic device. The enclosure may have one or more openings for providing an electrical connection between the actuator and the enclosed circuit of the electronic device. When the actuator is pressed, an electrical circuit may be closed and electric current may flow through the conductive inner surface of the actuator. The actuator may be combined with a perimeter element for snapping on and off the enclosure.

19 Claims, 5 Drawing Sheets

COSMETIC DOME SWITCH

CROSS-REFERENCE TO RELATED APPLICATION

This application claims the benefit of U.S. Provisional Patent Application Ser. No. 60/994,804, filed on Sep. 21, 2007, the entire contents of which are incorporated herein by reference in their entirety.

FIELD OF THE INVENTION

This invention is directed to a switch that has cosmetic attributes.

BACKGROUND OF THE INVENTION

Recent technological advances have facilitated the decrease in size of portable electronic devices such as portable music and video players and cellular telephones. Engineers have been able to reduce the size of circuitry and electronic components in electronic hardware such as the storage, memory and power supply units. However, the overall size of these devices is heavily influenced by the size and shape of its external mechanical components such as enclosures, input mechanisms (for example, switch components) and cosmetic components. These mechanical components pose several constraints on the reduction of the size of the devices. For example, switches used for powering or operating electronic devices can be relatively bulky because several mechanical components may be needed to transfer mechanical force applied by a user to switching an electrical circuit. Moreover, additional mechanical components may be required on the switches for cosmetic and informative purposes.

Typically, engineers attempt to minimize the size of these mechanical components by rearranging the device's electronic components to allow for a more compressed layout. Such rearranging can be cumbersome and at times nearly impossible given the constraints imposed by electrical circuit layouts and the size of the electronic components.

Accordingly, there is a need for smaller and more compact switching assemblies.

SUMMARY OF THE INVENTION

The systems and methods described herein are directed to a switch for use in an electronic device. The systems and methods described herein combine the electrical and mechanical components of the switch; the actuator has a conductive inner surface that connects to an electrical circuit and a cosmetic outer surface for providing information and an input interface to a user. The systems and methods described herein provide for thinner switching assemblies thereby allowing for a reduction in the size of the electronic device. For purposes of clarity, and not by way of limitation, the systems and methods may be described herein in the context of switching assemblies that are associated with electronic devices. However, it may be understood that the systems and methods described herein may be applied to any mechanical component associated with an electronic device.

The systems and methods provide switching assemblies for electronic devices, for example a dome switch having a cosmetic actuator. The switching assemblies may include an elastically deformable actuator having a conductive inner surface and a cosmetic outer surface. The actuator may be disposed on an exterior surface of an enclosure that houses the electric circuit board of the electronic device. The enclosure may have one or more openings for providing an electrical connection between the actuator and the enclosed circuit of the electronic device. When the actuator is pressed or displaced, an electrical circuit may be closed and electric current may flow through the conductive inner surface of the actuator. The actuator may be combined with a perimeter element for snapping on and off the enclosure.

In one aspect, the systems and methods described herein may include switch assemblies for an electronic device. The switch assemblies may include a housing for enclosing circuitry. The housing may include an exterior surface having an indentation, and at least two openings in the indentation for enclosing electrical contacts connected to the circuitry. The switch assemblies may further include a cover disposed over the indentation, overlapping the at least two openings and adapted to attach to the housing. The cover may include an elastically deformable actuator having an inner conducting surface for actuating the circuitry when connected to the electrical contacts. The cover may additionally include a perimeter element formed on the perimeter of the actuator and adapted to attach to the housing along the perimeter of the indentation. In some embodiments, the exterior surface of the housing on the indentation may be adapted to accommodate a circuit board.

The perimeter element may be co-molded with the actuator. In some embodiments, the perimeter element may be mechanically coupled to the housing along the perimeter of the indentation. In such embodiments, the housing may include a recess extending along the perimeter of the indentation and shaped to receive the perimeter element such that the perimeter element may mechanically couple with the recess to attach to the housing. The perimeter element may snap fit or press fit to the housing along the perimeter of the indentation. Alternatively, or in addition, the perimeter element may be coupled to the housing using an adhesive tape, a mechanical fastener, or any other suitable coupling mechanism.

In some embodiments, the perimeter element may include a portion formed from an elastomeric material. The actuator may be formed from at least one of metal, plastic, composite material and elastomers.

In some embodiments, the housing includes a plurality of retention openings near the perimeter of the indentation, and the perimeter element includes one or more retention legs adapted to couple with the retention openings for attaching the cover to the housing.

In another aspect, the systems and methods described herein may include a switch assembly for an electronic device. The switch assembly may include a housing for enclosing circuitry, the housing including at least two openings for enclosing electrical contacts connected to the circuitry. The assembly may include a cover disposed on a surface of the housing over the at least two openings. The cover may include an elastically deformable actuator having an inner conducting surface for actuating the circuitry when connected to the electrical contacts. The cover may further include a perimeter element attached to a perimeter of the actuator. In certain embodiments, the assembly may include a retaining flange attached to the housing, disposed along the perimeter of the cover and overlapping a portion of the perimeter element.

In some embodiments, the flange may include one or more protrusions for restraining the cover in between the housing and the retaining flange. The flange may be formed from at least one of metal, plastic and composite materials.

The flange may be attached to the housing using adhesive, tape, press fit, welding, or any other suitable attachment mechanism.

In yet another aspect, the systems and methods described herein may include a switch assembly for an electronic device. The switch assembly may include a housing enclosing circuitry and several retention openings. The assembly may include a cover disposed on a surface of the housing over the several retention openings. The cover may include an elastically deformable actuator having an inner conducting surface for actuating the circuitry. The cover may further include at least one retention leg attached to the actuator and configured to fit through the plurality of retention openings for attaching the cover to the housing.

In some embodiments, one or more retention legs may be attached to the actuator by at least one of welding, soldering, co-molding and adhesion. The retention legs may be mechanically coupled to the housing. The retention legs may occupy the retention openings and may be snap fit to the housing.

In still another aspect, the systems and methods described herein may include a switch assembly for an electronic device. The switch assembly may include a housing for enclosing circuitry, the housing including several openings for enclosing electrical contacts connected to the circuitry. The assembly may also include a cover disposed on a surface of the housing. The cover may include an elastically deformable actuator having an inner surface with several spaced apart conducting regions for actuating the circuitry when positioned over the several openings and connected to the electrical contacts. In some embodiments, the assembly may include a retaining flange attached to the housing and disposed along the perimeter of the cover to retain the cover in position on the housing.

In another aspect, the systems and methods described herein may include methods of manufacturing a switch assembly for an electronic device. The method may include providing a housing and a cover. The housing may enclose electronic circuitry, and have an indentation on an exterior surface, and several openings in the indentation. The cover may include an elastically deformable actuator having an inner conducting surface and a perimeter element formed on the perimeter of the actuator. The method may include connecting one or more conducting elements to the circuitry such that the conducting elements pass through the several openings. The cover may be attached to the housing by coupling the perimeter element with the perimeter of the indentation of the housing.

In still another aspect, the systems and methods described herein may include a switch assembly. The switch assembly may include a housing with an exterior surface having an indentation, and at least two openings on the exterior surface and within the indentation. The switch assembly may further include an electrical circuit board disposed within the housing such that a portion of the circuit board is accessible through the openings. The assembly may also include a cover and at least two conducting elements. The cover may be disposed over the indentation, overlapping the at least two openings and adapted to attach to the housing. The cover may include an elastically deformable actuator having an inner conducting surface. The cover may further include a perimeter element formed on the perimeter of the actuator and adapted to attach to the housing along the perimeter of the indentation. In some embodiments, the at least two conducting elements, for example conducting springs, may be disposed within the openings and connected to the electrical circuit board such that at least one of the conducting elements is connected to the inner conducting surface of the cover. The cover may electrically connect the at least two conducting elements when the elastically deformable actuator is depressed.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE ILLUSTRATED EMBODIMENTS

As will be seen from the following description, in some aspects, the systems and methods provide for switching assemblies for electronic devices (e.g., a dome switch having a cosmetic actuator). The switching assemblies may include an elastically deformable actuator having a conductive inner surface and a cosmetic outer surface. The actuator may be disposed on an exterior surface of an enclosure that houses the electric circuit board of the electronic device. The enclosure may have one or more openings for providing an electrical connection between the actuator and the enclosed circuit of the electronic device. When the actuator is pressed or moved, an electrical circuit may be closed and electric current will flow through the conductive inner surface of the actuator. The actuator may be combined with a perimeter element for snapping on and off the enclosure.

Figure 1:
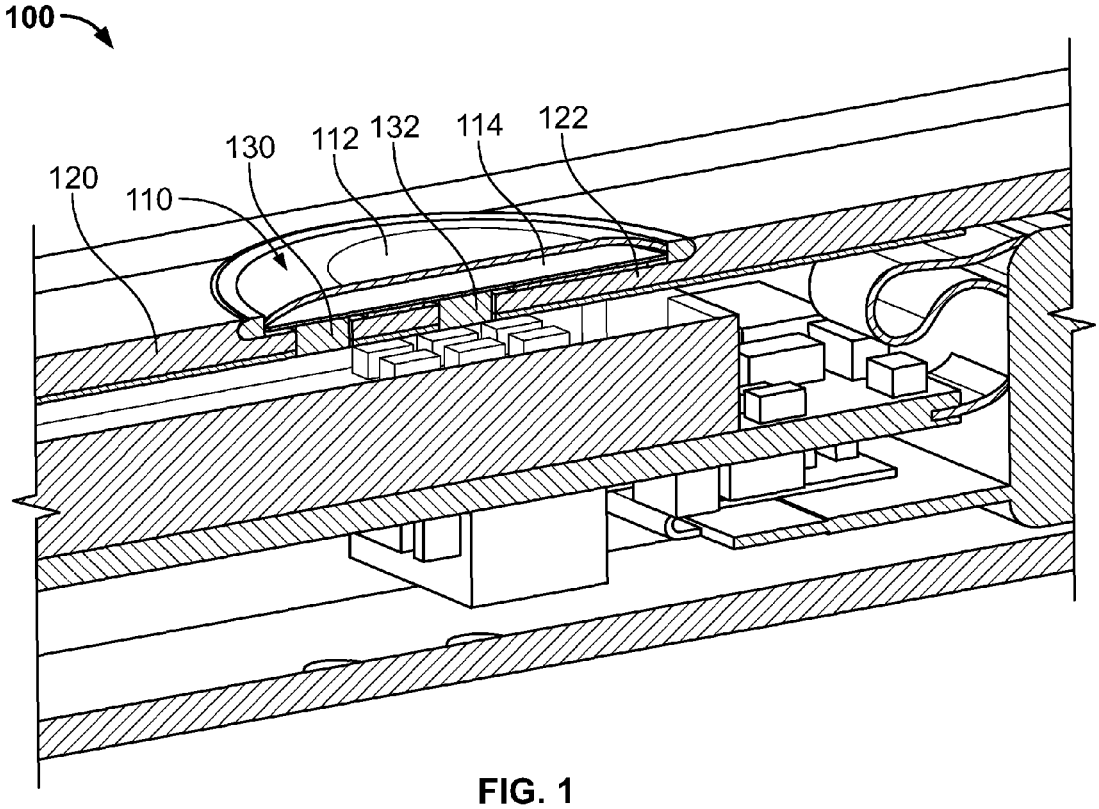
FIG. 1 is a cross-sectional view of an illustrative cosmetic dome switch assembly in accordance with one embodiment of the invention.

FIG. 1 is a cross-sectional view of an illustrative cosmetic switch assembly in accordance with one embodiment of the invention. Switch assembly 100 may include dome switch 110 and housing 120. Dome switch 110 may include any suitable switch operative to be mounted in housing 120. Housing 120 may form the outer surface of an electronic device or electronic component, for example the outer surface of a portable media device (e.g., an iPod available from Apple Inc. of Cupertino, Calif.), or a portable media device accessory (e.g., an audio controller for a portable media device or an in-line microphone with an input mechanism). Housing 120 may be manufactured from any suitable material using any suitable manufacturing process. For example, housing 120 may be manufactured from a metal (e.g., aluminum or stainless steel), plastic, a composite material, or any other suitable material.

Switch 110 may include any suitable switch. For example, switch 110 may include a dome switch. In some embodiments, switch 110 may be constructed such that it is exposed and directly actuated by the user (e.g., without a cap being placed over the dome switch). Switch 110 may include dome 112 operative to be mounted in indentation 122 of housing 120. Dome 112 may be constructed from any suitable material, including for example metal (e.g., aluminum or steel), plastic, a composite material, an elastomer, or any other suitable material. In some embodiments, dome 112 may be finished (e.g., polished, etched, or decorated) to provide an aesthetically pleasing and cosmetic surface. Switch 110 may include surface decals, adhesives and/or other suitable markings for providing instructions and guidance to a user. Dome 112 may be constructed such that, in response to a user actuation of switch 110 (e.g., in response to a user pressing dome 112), dome 112 may elastically deform (e.g., into free space 114) such that a portion of dome 112 contacts board 130 (e.g., a flex) or spring 132 (e.g., a copper or conductive rubber flexible component) to short an electric circuit and provide an electric signal to the electronic device of assembly 100.

Figure 2:
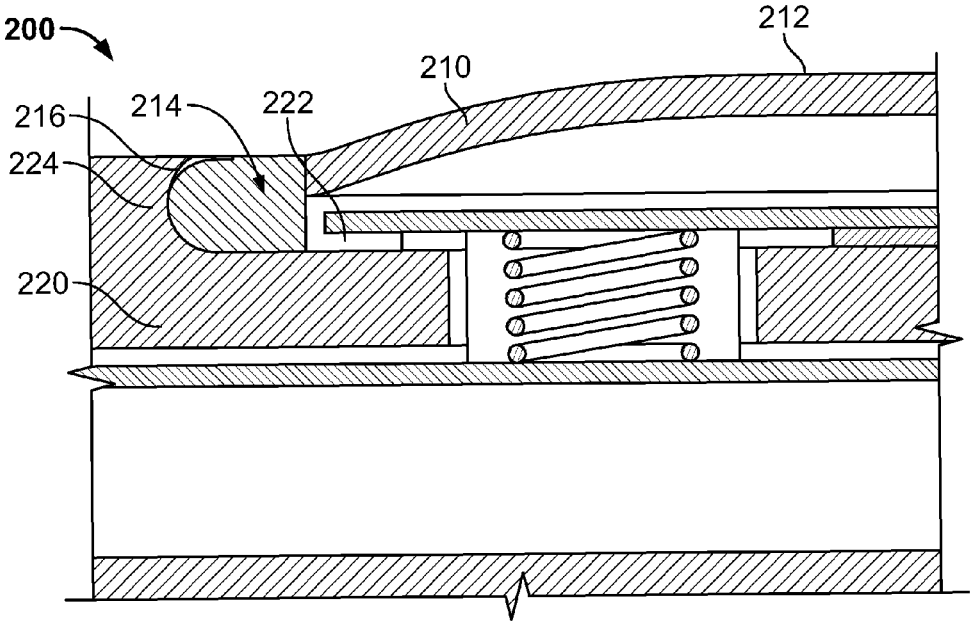
FIG. 2 is a cross-sectional view of an illustrative switch mounted in a housing using a co-molded ring in accordance with one embodiment of the invention.

Switch 110 may be mounted in housing 120 using any suitable approach. In some embodiments, a switch may be coupled to a housing by placing a film coupled to the housing (e.g., using an adhesive) over the switch. In some embodiments, a switch may be press fit into a housing. FIG. 2 is a cross-sectional view of an illustrative switch mounted in a housing using a co-molded ring to form a cover in accordance with one embodiment of the invention. Switch assembly 200 may include switch 210 and housing 220. In some embodiments, dome 212 of switch 210 may be mounted in indentation 222 in the top surface of housing 220 using perimeter element or ring 214 operative to be snapped into recess 224 of housing 220. Thus, switch 210 may be mounted in housing 220 from the outside of the housing. Ring 214 may be constructed from any suitable material, including for example plastic, metal, or an elastomer. Ring 214 may be coupled to dome 212 using any suitable approach. In some embodiments, ring 214 may be co-molded around the periphery of dome 212 to create an elastically deformable surface operative to snap into recess 224. Outer surface 216 of ring 214 may be constructed to match recess 224 to provide a secure fit for dome 212 when it is inserted in indentation 222. In some embodiments, the perimeter element or ring 214 may be finished (e.g., polished, etched, or decorated) to provide an aesthetically pleasing and cosmetic surface.

Figure 3:
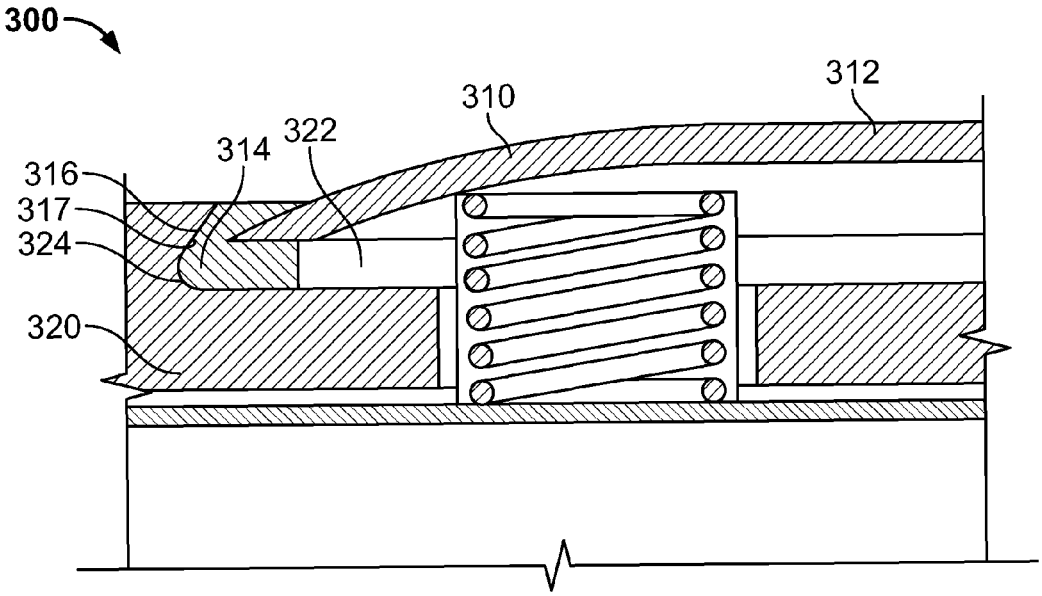
FIG. 3 is a cross-sectional view of another illustrative switch assembled into a housing using a co-molded ring in accordance with one embodiment of the invention.

Outer surface 216 of ring 214 may have any suitable shape. In some embodiments, outer surface 216 may be constructed in a shape operative to increase the force required to remove ring 214 from recess 224, thus preventing accidental removal of switch 210 from housing 220. FIG. 3 is a cross-sectional view of another illustrative switch mounted in a housing using a co-molded ring in accordance with one embodiment of the invention. Switch assembly 300 may include switch 310 and housing 320. Dome 312 of switch 310 may include ring 314 operative to be received in recess 324 of indentation 322 of housing 320. Outer surface 316 of ring 314 (and corresponding recess 324) may be constructed such that upper surface 317 of ring 314 is angled towards the outer surface of dome 312, and extends at least to half the height of ring 314. The amount of upper surface 317 in contact with recess 324, the angle at which upper surface 317 extends toward the outer surface of housing 320, and the elasticity of ring 314 may be modified to change the tightness of the fit of switch 310 in housing 320.

Figure 4:
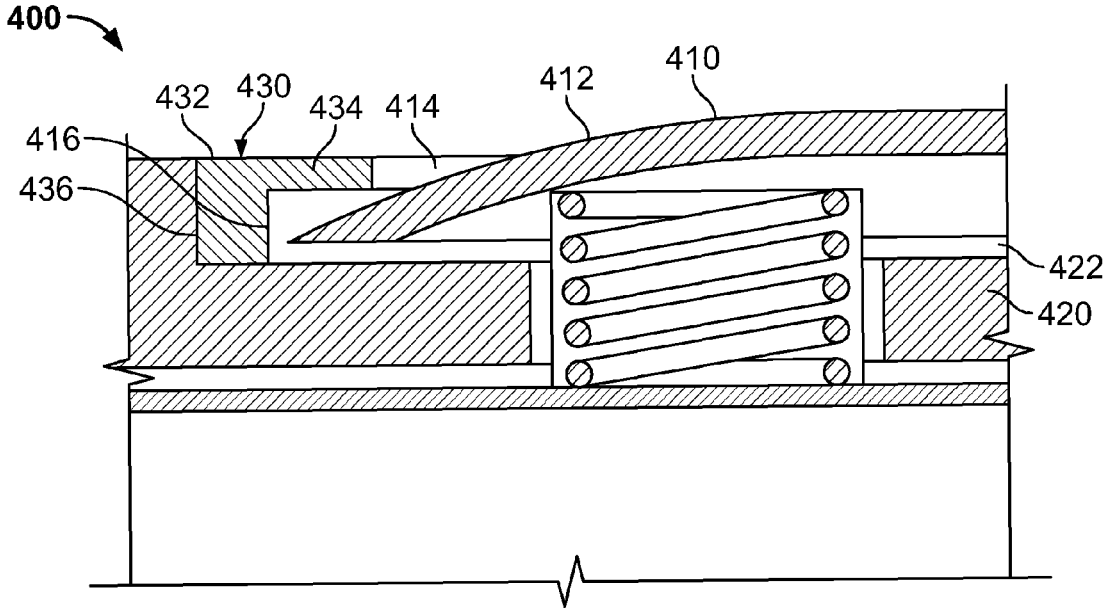
FIG. 4 is a cross-sectional view of an illustrative switch assembled into a housing using a flange in accordance with one embodiment of the invention.

In some embodiments, the switch may be mounted to the housing using a retaining flange placed over the dome. FIG. 4 is a cross-sectional view of an illustrative switch mounted in a housing using a flange in accordance with one embodiment of the invention. Switch assembly 400 may include switch 410 and housing 420. Switch 410 may include dome 412 and ring 414, which may be coupled to dome 412 using any suitable approach (e.g., co-molding). Housing 420 may include indentation 422 operative to receive dome 412 and ring 414. To ensure that switch 410 remains enclosed in indentation 422, assembly 400 may include flange 430 operative to be placed over at least a portion of dome 412, ring 414, or both. Upper surface 432 of flange 430 may be constructed such that flange 430 is flush with the outer surface of housing 420 (e.g., to provide a low profile and an aesthetically pleasing surface). Lower surface 434 of flange 430 may be constructed to match upper surface 416 of ring 414.

Flange 430 may be constructed from any suitable material. For example, flange 430 may be constructed from a metal, plastic, composite material, or any other suitable material. Flange 430 may be coupled to housing 420 using any suitable approach. For example, flange 430 may be coupled to housing 420 using an adhesive, tape (e.g., clear tape), a press fit, welding (e.g., at contact point 436 between flange 430 and housing 420), or any other suitable approach. In some embodiments, flange 430 may include one or more posts or protrusions (e.g., snaps) operative to engage housing 420 to restrict dome 412 and ring 414 to the space between housing 420 and flange 430. In some embodiments, one or more flanges 430 may be operative to couple several switches 410 to housing 420. The flange 430 may be finished (e.g., polished, etched, or decorated) to provide an aesthetically pleasing and cosmetic surface.

Figure 5A:
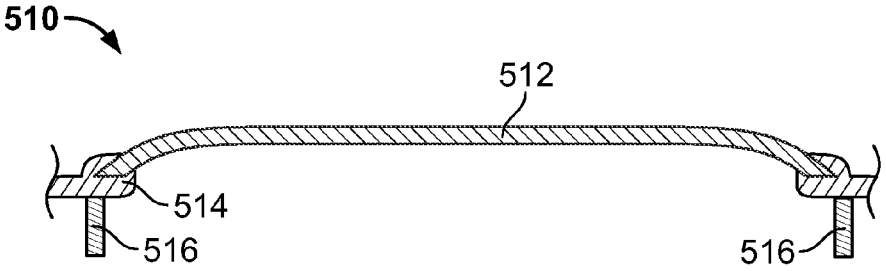
FIG. 5A is a cross-sectional view of an illustrative switch assembly having at least one post extending from a flange in accordance with one embodiment of the invention.

In some embodiments, one or both of the dome and ring may include posts with tabs extending from the surface of the dome and ring, respectively, and operative to engage the housing. FIGS. 5A-5E are schematic views of illustrative switch systems having posts extending from at least one of the dome and ring in accordance with one embodiment of the invention. FIG. 5A is a cross-sectional view of an illustrative switch having at least one post extending from a ring in accordance with one embodiment of the invention. Switch 510 may include dome 512 and ring 514, where ring 514 may be coupled to dome 512 using any of the approaches discussed above. Switch 510 may include one or more posts 516 extending from ring 514 such that posts 516 extend away from the outer surface of dome 512 and towards the inside of a housing when switch 510 is mounted in the housing.

Figure 5B:
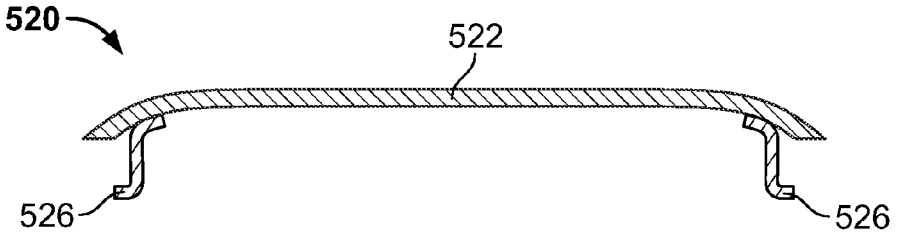
FIG. 5B is a cross-sectional view of an illustrative switch having at least one post extending from a dome in accordance with one embodiment of the invention.

FIG. 5B is a cross-sectional view of an illustrative switch having at least one post extending from a dome in accordance with one embodiment of the invention. Switch 520 may include dome 522, which may include one or more posts 526 extending from dome 522 such that posts 526 extend away from the outer surface of dome 522 and towards a housing when switch 520 is mounted in the housing.

Posts 516 and 526 may be coupled to ring 514 and dome 522, respectively, using any suitable approach. For example, posts 516 and 526 may be welded, soldered, molded, formed, coupled using an adhesive or tape, mechanically coupled (e.g., using a press fit or a snap), heat treated (e.g., melted to ring 514 or dome 522), or coupled to ring 514 and dome 522, respectively, using any other suitable approach. Posts 516 and 526 may be coupled to the housing using any suitable approach. For example, posts 516 may be coupled to the housing using one or more of a press fit, an adhesive, tape, a mechanical engagement (e.g., a snap), welding, soldering, or any other suitable approach. In some embodiments, the length of posts 516 and 526 may exceed the length required to be coupled to the housing. The excess length may allow easier placement of switch 510 or 520 in the housing by permitting the posts to be pulled or manipulated to properly place the switch in the housing. The excess length of the posts may be subsequently removed prior to completing the assembly of the electronic device or accessory (e.g., cutting the excess length once the switch is coupled to the housing).

Figure 5C:
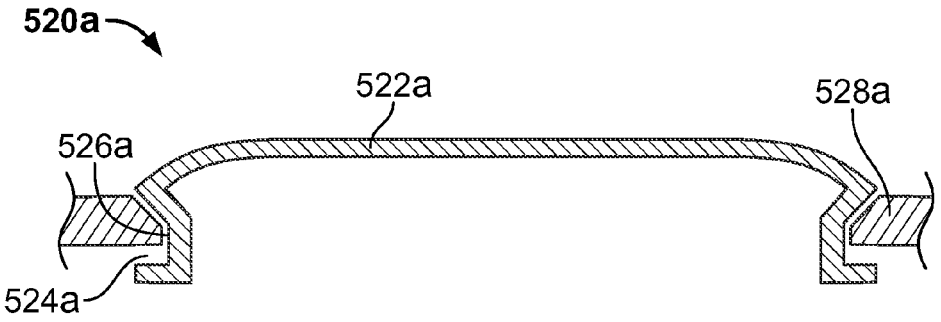
FIG. 5C is a cross-sectional view of an illustrative switch having posts extending through an aperture of a housing in accordance with one embodiment of the invention.

FIG. 5C is a cross-sectional view of an illustrative switch having posts extending through an aperture of a housing in accordance with one embodiment of the invention. Switch 520*a* may include dome 522*a* having posts 526*a* extending away from the outer surface of dome 522*a* and into an aperture of housing 528*a* when switch 520*a* is mounted in housing 528*a*. Posts 526*a* may include snaps 524*a* extending from posts 526*a* in a direction perpendicular to posts 526*a* such that snaps 524*a* may engage housing 528*a* to prevent switch 520*a* from disengaging housing 528*a* (e.g., preventing switch 520*a* from being pulled towards the outer surface of housing 528*a*). In some embodiments, posts 526*a* and the aperture of housing 528*a* may be inclined such that the shape of posts 526*a* prevents switch 520*a* from passing through housing 528*a* (e.g., falling into the housing). In some embodiments, the aperture 528*a* and/or the posts 526*a* may be sized such that the posts 526*a* are prevented from passing through the housing. For example, the posts 526*a* may have a tapered diameter and the aperture 528*a* may have a diameter less than the diameter of the posts 526*a* at the widest point on the post 526*a*.

Figure 5D:
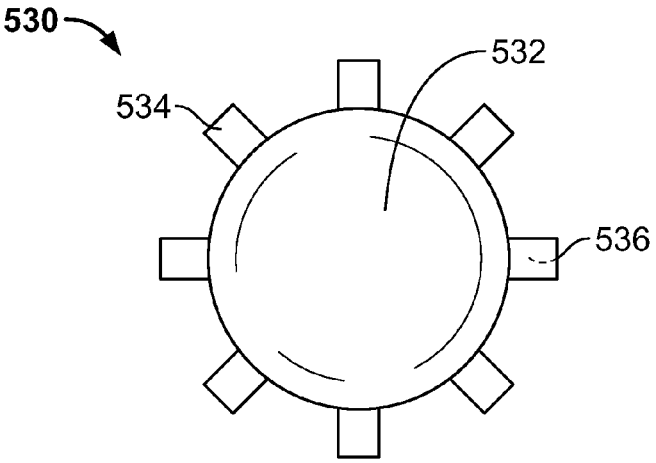
FIGS. 5D and 5E are a top view and a cross-sectional view of an illustrative switch having several tabs operative to engage a housing in accordance with one embodiment of the invention.
Figure 5E:
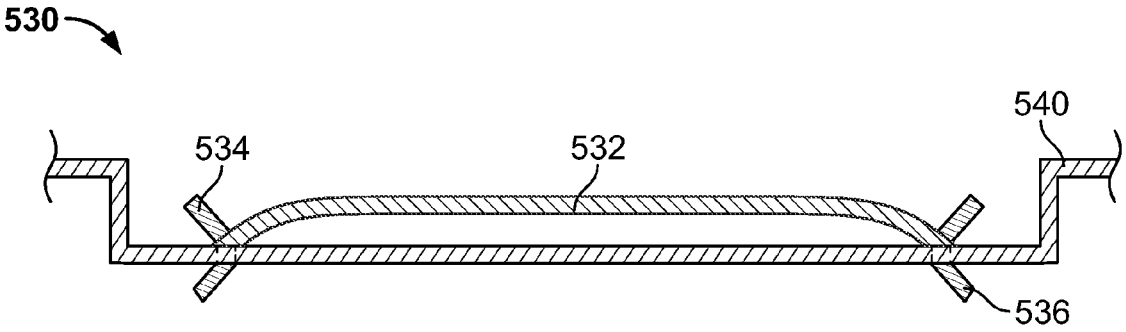

FIGS. 5D and 5E are a top view and a cross-sectional view of an illustrative switch having several tabs operative to engage a housing in accordance with one embodiment of the invention. Switch 530 may include dome 532 and several tabs 534 and 536. Tabs 534 and tabs 536 may extend from the periphery of dome 532 such that tabs 534 are inclined towards the top of dome 532, and tabs 536 are inclined away from the top of dome 532. When switch 530 is placed in an aperture of housing 540, switch 530 may be restrained from passing through the aperture by both tabs 534 and tabs 536. In some embodiments, a flange or other cover (not shown) may be placed over switch 530 to hide tabs 534 so as to provide an aesthetically pleasing cosmetic switch.

Figure 6:
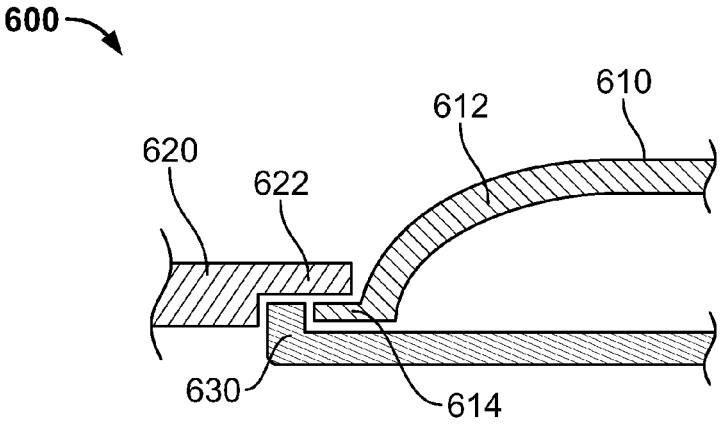
FIG. 6 is a cross-sectional view of an illustrative switch assembled into a housing using a plate in accordance with one embodiment of the invention.

FIG. 6 is a cross-sectional view of a switch mounted in a housing using a plate in accordance with one embodiment of the invention. Switch assembly 600 may include switch 610 and housing 620. Switch 610 may include dome 612 and ring 614, which may be coupled to the housing 620 using any of the approaches described above. Switch 610 may be mounted in housing 620 from the bottom (e.g., from the inside of the housing, instead of snapping the switch into the housing from the outside of the housing). Housing 620 may include undercut 622 operative to receive one or both of dome 612 and ring 614. To prevent switch 610 from disengaging undercut 622, assembly 600 may include plate 630 operative to be coupled to housing 620 such that switch 610, may be retained between undercut 622 and plate 630. Plate 630 may be coupled to housing 620 using any suitable approach, including for example an adhesive, a press fit, a mechanical coupling (e.g., a snap), welding, soldering, or any other suitable approach. In some embodiments, one or more plates 630 may be operative to retain several switches 610 in housing 620.

Figure 7:
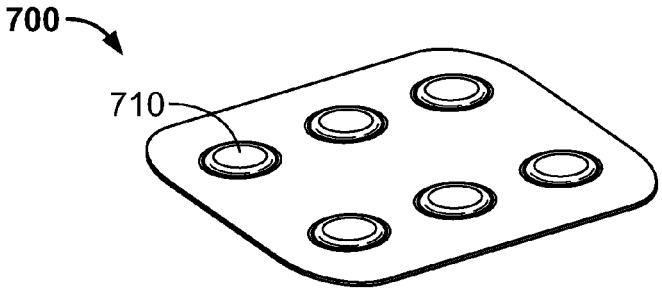
FIG. 7 is a schematic view of an illustrative sheet of switches in accordance with one embodiment of the invention.

In some embodiments, a housing may include several switches (e.g., dome switches). The switches may be coupled to the housing using any suitable approach. For example, the switches may be coupled to the housing individually, or as a sheet of switches. In some embodiments, switches may be manufactured by stamping switches in a strip of material (e.g., metal), punching each individual switch, and subsequently mounting each individual switch in the housing. In some embodiments, the housing may instead include a sheet having several switches. FIG. 7 is a schematic view of an illustrative sheet of switches in accordance with one embodiment of the invention. Sheet 700 may include several switches 710 distributed in any suitable pattern. In some embodiments, the pattern used to distribute switches 710 may match the pattern of switch locations in a housing. Sheet 700 may be trimmed to fit the allowable space of a housing. If sheet 700 includes sufficient switches for several housings, a single sheet 700 may be cut and assembled in several housings. The stiffness of sheet 700 and the distance between switches 710 may be selected such that when a user actuates a particular switch 710, other switches 710 in sheet 700 are not also actuated.

Figure 8:
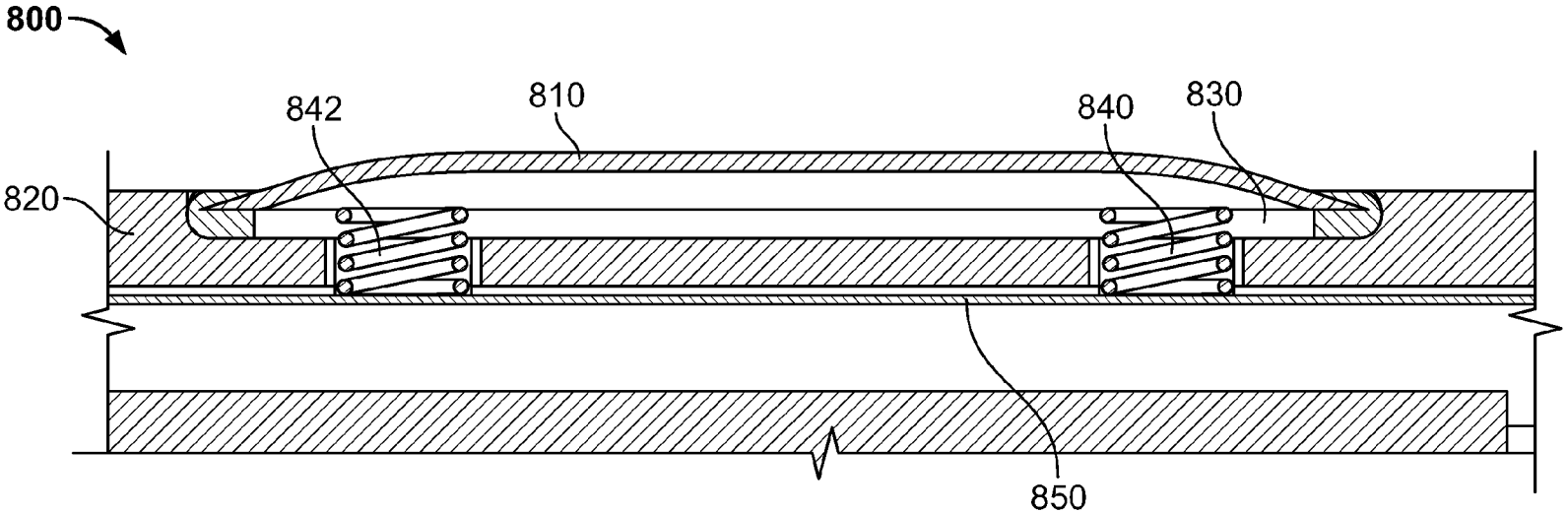
FIG. 8 is a cross-sectional view of an illustrative switch assembly in accordance with one embodiment of the invention.

Each switch may be operative to provide an electrical signal indicating that the switch has been actuated using any suitable approach. FIG. 8 is a cross-sectional view of an illustrative switch assembly in accordance with one embodiment of the invention. Switch assembly 800 may include switch 810 coupled to housing 820. Switch 810 may be coupled to housing 820 using any suitable approach, including for example any of the approaches described above. Switch assembly may include flex 830 positioned between the interior surface of switch 810 and the upper surface of the indentation of housing 820 operative to receive switch 810. Flex 830 may be electrically conductive such that an electrical contact of switch 810 (the inner surface of which may be conductive) with the upper surface of flex 830 may be transmitted to at least one of springs 840 and 842. Switch assembly 800 may include flex 850, which may be coupled to a processor or other control circuitry operative to receive electrical signals from switch 810.

Switch assembly may include any suitable number of springs 840 and 842 (e.g., three springs). Springs 840 and 842 may include any suitable conductive portion operative to provide an electrically conductive path between flex 830 and flex 850 through housing 820 or springs with a conductive element (e.g. constructed from a metal or conductive rubber). For example, springs 840 and 842 may include copper springs placed in apertures of housing 820. When switch 810 is actuated (e.g., a user presses switch 810), at least two points of the inner surface of switch 810 may be brought into contact with flex 830 such that the circuit including flex 830, springs 840 and 842 and flex 850 may be shorted, thus sending an electrical signal that control circuitry can process.

Figure 9:
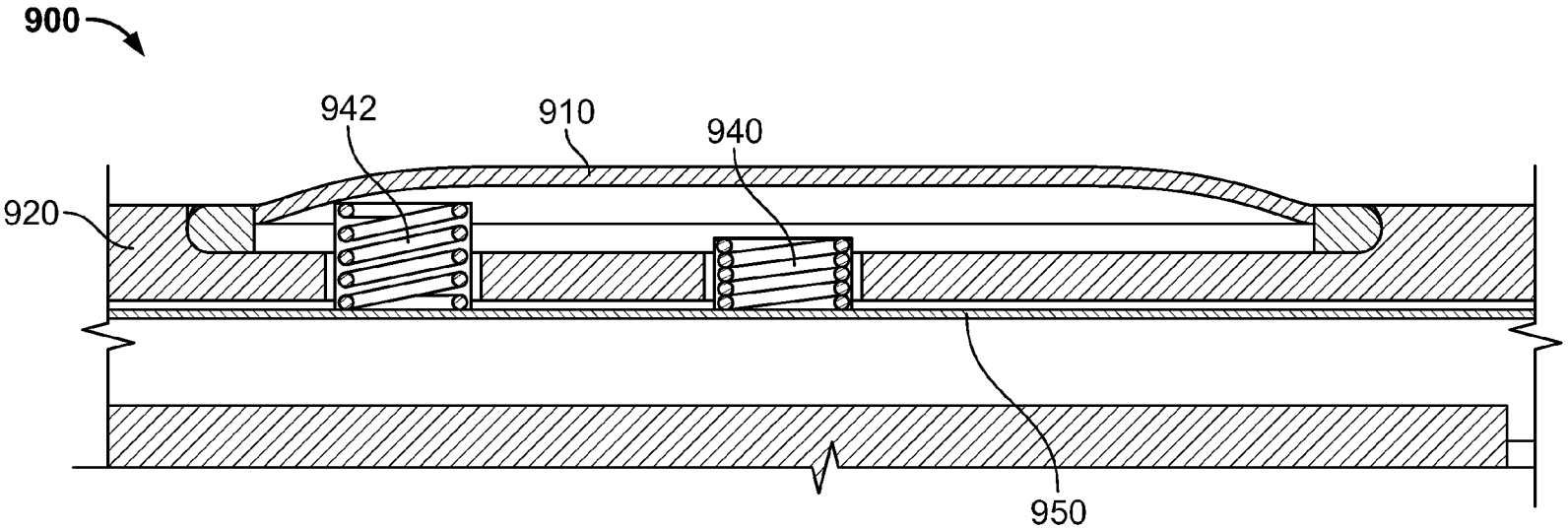
FIG. 9 is a cross-sectional view of an illustrative switch assembly having only one flex in accordance with one embodiment of the invention.

In some embodiments, flex 830 may be eliminated. FIG. 9 is a cross-sectional view of an illustrative switch assembly having only one flex in accordance with one embodiment of the invention. Switch assembly 900 may include switch 910, housing 920, springs 940 and 942, and flex 950, which may include some or all of the features of switch 810, housing 820, springs 840 and 842, and flex 850 of switch assembly 800 (FIG. 8). Because switch assembly 900 may not include a flex between switch 910 and springs 940 and 942, springs 940 and 942 may be extended such that, when switch 910 is actuated, the inner surface of switch 910 may come directly in contact with springs 940 and 942. Then, in response to an actuation of switch 910, the circuit including springs 940 and 942 and flex 950 may be shorted.

Variations, modifications, and other implementations of what is described may be employed without departing from the spirit and scope of the invention. More specifically, any of the method, system and device features described above or incorporated by reference may be combined with any other suitable method, system or device features disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

What is claimed is:

1. An electronic device, comprising:

a housing for enclosing circuitry, the housing comprising an exterior surface of the electronic device and having an indentation within the exterior surface;

a perimeter element disposed along a perimeter of the indentation and encircling a dome; and the dome attached to the housing using the perimeter element, the dome having an inner conducting surface operative to contact at least one electrical contact of the circuitry and an outer surface operative to receive a user actuation.

2. The electronic device of claim 1, wherein the perimeter element is co-molded around a perimeter of the dome.

3. The electronic device of claim 1, wherein the perimeter element is mechanically coupled to the housing along the perimeter of the indentation.

4. The electronic device of claim 3, wherein the housing comprises a recess extending around the perimeter of the indentation and shaped to receive the perimeter element such that the perimeter element is operative to engage with the indentation to attach to the housing.

5. The electronic device of claim 3, wherein the perimeter element is snap fit to the housing along the perimeter of the indentation.

6. The electronic device of claim 3, wherein the perimeter element is press fit to the housing along the perimeter of the indentation.

7. The electronic device of claim 1, wherein the perimeter element comprises an elastomer.

8. The electronic device of claim 1, wherein the housing includes a plurality of retention openings near a perimeter of the indentation, and the perimeter element includes one or more retention legs adapted to be inserted in the retention openings for attaching the dome to the housing.

9. The electronic device of claim 1, wherein the housing is adapted to accommodate a board.

10. The electronic device of claim 1, wherein the outer surface of the dome is exposed for direct actuation by the user.

11. An electronic device, comprising:

a housing for enclosing circuitry, the housing comprising an external surface and a plurality of indentations formed within the external surface;

a plurality of perimeter elements, each perimeter element disposed within a respective indentation; and a plurality of domes, each dome secured within the respective indentation of the housing by a respective perimeter element, the dome having an inner conducting surface operative to contact at least one electrical contact of the circuitry and an outer surface is exposed to receive a direct user actuation.

12. The electronic device of claim 11, further comprising a retaining flange, wherein the retaining flange includes one or more protrusions for restricting the dome between the housing and the retaining flange.

13. The electronic device of claim 12, wherein the flange is formed from at least one of metal, plastic and composite material.

14. The electronic device of claim 12, wherein the flange is attached to the housing using at least one of adhesive, tape, press fit and welding.

15. An electronic device, comprising:

a housing for enclosing circuitry, the housing comprising an external surface and at least one retention opening within the external surface;

a dome having multiple posts formed around a perimeter of the dome, wherein:

the dome is secured within the at least one retention opening using the multiple posts; and the dome having an inner conducting surface operative to contact at least one electrical contact of the circuitry and an exposed outer surface for receiving a user actuation.

16. The electronic device of claim 15, wherein the multiple posts are attached to the dome by at least one of welding, soldering, co-molding and adhesion.

17. The electronic device of claim 15, wherein the multiple posts are mechanically coupled to the housing.

18. The electronic device of claim 17, wherein the multiple posts are snap fit to the at least one retention opening.

19. A method of manufacturing an electronic device, comprising:

providing a housing having electronic circuitry enclosed therein, an exterior surface that forms a top surface of the electronic device, an indentation within the exterior surface, and a plurality of openings in the indentation;

connecting one or more conducting elements to the circuitry such that the conducting elements pass through the plurality of openings;

providing a dome having an inner conducting surface operative to be electrically connected to the one or more conducting elements and an exposed outer surface operative to receive a user actuation, and a perimeter element formed on a perimeter of the dome; and attaching the dome to the housing by coupling the perimeter element with a perimeter of the indentation.

* * * * *